US006782586B2

(12) United States Patent
Reppert

(10) Patent No.: US 6,782,586 B2
(45) Date of Patent: Aug. 31, 2004

(54) ADJUSTABLE REINFORCING HINGE

(76) Inventor: James Reppert, 116 N. Carousel St., Anaheim, CA (US) 92806

( * ) Notice: Subject to any disclaimer, the term of this patent is extended or adjusted under 35 U.S.C. 154(b) by 15 days.

(21) Appl. No.: 10/286,056

(22) Filed: Nov. 1, 2002

(65) Prior Publication Data

US 2004/0083576 A1 May 6, 2004

(51) Int. Cl.[7] ..... E05D 7/04
(52) U.S. Cl. ..... 16/242; 16/382
(58) Field of Search ..... 16/229, 230, 232, 16/382, 86.1, 235, 250, 242, 243; 403/52

(56) References Cited

U.S. PATENT DOCUMENTS 3,469,276 A 9/1969 Dickson ..... 16/135
3,561,038 A * 2/1971 Bennett ..... 16/389
4,228,561 A 10/1980 Gwozdz ..... 16/131
4,937,916 A 7/1990 Redman ..... 16/243
5,056,193 A 10/1991 Colamussi ..... 16/262

* cited by examiner

*Primary Examiner*—Gary S. Hartmann
(74) *Attorney, Agent, or Firm*—Steins & Associates, P.C.

(57) ABSTRACT

An Adjustable Reinforcing Hinge is disclosed. Also disclosed isa hinge that replaces a broken or otherwise damaged door hinge. The reinforcing hinge is easily adjusted once installed in order to achieve superior alignment between the door and door jam. The hinge is further dimensioned so as to simplify the initial locating and mounting of the hinge on the door and door frame. The process for installing the reinforcing hinge includes the use of the specially-dimensioned elements of the hinge to also act as alignment guides during the location and installation of the reinforcing hinge.

8 Claims, 8 Drawing Sheets

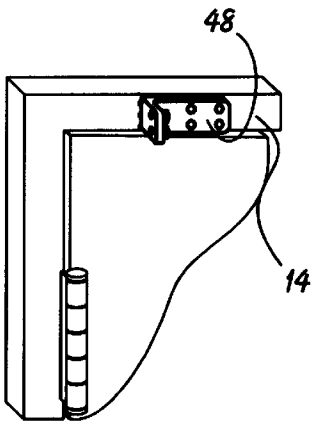
FIGURE 8A
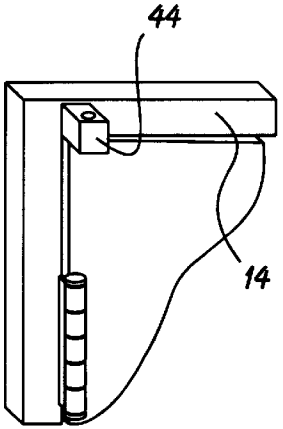
FIGURE 8B
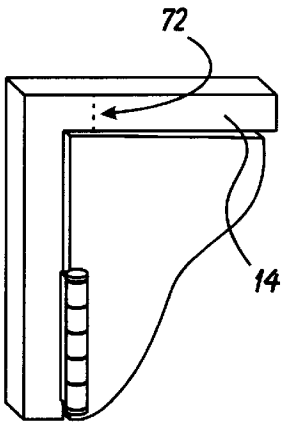
FIGURE 8C
FIGURE 8D
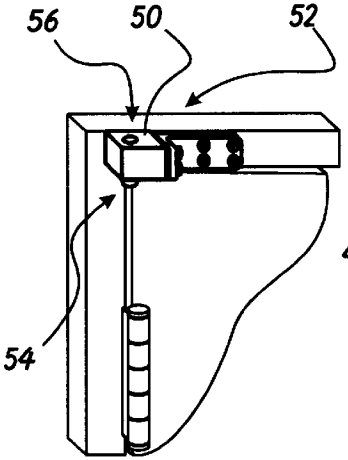
FIGURE 8E
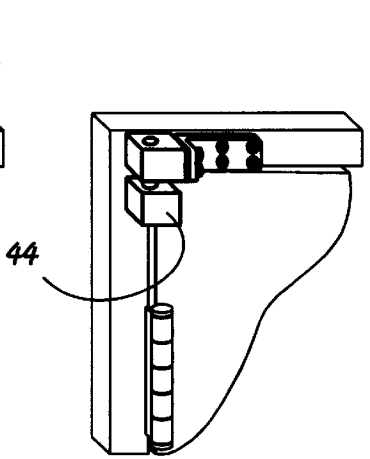
FIGURE 8F
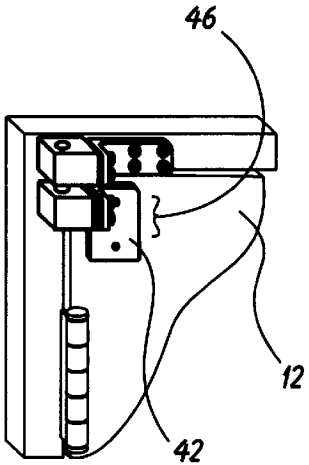
FIGURE 8G
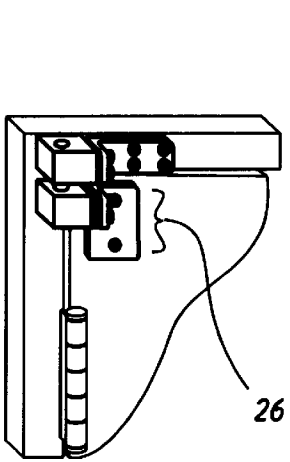
FIGURE 8H

ADJUSTABLE REINFORCING HINGE

BACKGROUND OF THE INVENTION

1. Field of the Invention

This invention relates generally to doors and hardware related thereto and, more specifically, to an Adjustable Reinforcing Hinge 2. Description of Related Art Steel-framed doors are widely used in commercial construction. In particular, the hotel industry uses expensive, high-strength steel frames coupled with heavy duty doors in order to provide superior security as well as long-term durability. FIG. 1 is a perspective view of a conventional hinged door assembly 10 used in hotels and other commercial buildings. The major components of the assembly 10 are a heavy-duty door 12, a heavy-duty steel door frame 14, and a door hinge 16 interconnecting the two via a hinge pin 18.

The problem with the conventional assembly 10 is that when the assembly 10 is subjected to extreme conditions, such as repetitive door 12 slamming or if the door 12 is struck by maintenance (or other) equipment, it is not uncommon for misalignments to occur in the hinge 16. In particular, the hinge 16 can become partially detached from either the door 12 or frame 14, or both. Once the hinge 16 begins to separate from either of these elements, the door 12 will no longer open and close properly. In fact, it is very common for the door 12 to no longer provide a fume-tight seal when closed; this can create a problem in satisfying fire code requirements. If we turn to FIG. 2, we can examine one version of a device that seeks to repair or protect the hinges of a door such as depicted in FIG. 1.

FIG. 2 is a perspective view of a prior art "shock pivot hinge" 20 as described in Gwozdz, U.S. Pat. No. 4,228,561. The Gwozdz pivot hinge 20 consists of a door leaf 22 attached to the door 12 via a plurality of mounting screws 26, and a upper jam leaf 24 attached to the door frame 14 via a plurality of mounting screws 26. The leafs 22 and 24 are interconnected by a pivot pin 28; the pivot hinge 20 is installed such that the axis of the pivot pin 28 is the same axis as the hinge pin 18 (when the door 12 is closed). After installed, the pivot hinge 20 is intended to prevent the door 12 from sagging when opened due to damaged components in the hinge 16.

While the Gwozdz device meets its goal when the hinge 18 dimensions are of the type for which the pivot hinge 20 is designed. If, however, a hinge 16 is encountered that is not typical (or at least one for which the pivot hinge 20 is designed to work with), then the leafs 22 and 24 and pivot pin 28 might not be functional. For example, if the gap between the top or side of the door 12 and frame 14 is particularly large, the upper jam leaf 24 might not be able to be securely mounted to the frame 14, because the frame cannot be reached (due to the fixed length of the pivot pin 28). Furthermore, if there are persistent misalignments between the door 12 and frame 14, the Gwozdz device cannot be adjusted to compensate for them; the relationship between the pivot pin 28 and the leafs 22 and 24 is fixed, and there can be no adjustment. If we now turn to FIG. 3, we can examine yet another attempt at solving the problem of broken hinges.

FIG. 3 is a perspective view of another prior art reinforcing hinge, namely the "non-handed shock arrestor door pivot" 30 disclosed by Colamussi, U.S. Pat. No. 5,056,193. The Colamussi device 30 consists of a frame member 32 attached to the frame 14 by mounting screws 26, and a door member 34 attached to the door 12 by mounting screws 26. The members 32 and 34 each have first and second pivot apertures 36A and 36B, respectively, formed therethrough for accepting a pivot member 38 therein (i.e. a hinge pin). While the Colamussi device 30 does provide the user with the flexibility of installing the device 30 on either a right-handed or left-handed door 12 (i.e. doors with its hinges mounted on either the right or left side of the door), it does not solve the problems discussed above in connection with the Gwozdz device. Specifically, the pivot member 38 is inserted into the apertures 36A or 36B, and then screwed into place; this prevents the vertical distance between the frame member 32 and the door member 34 from being adjusted. Furthermore, as with the Gwozdz device, there is no way to adjust the orientation between the members 32 and 34 and the axis of the pivot member 38.

SUMMARY OF THE INVENTION

In light of the aforementioned problems associated with the prior devices and systems, it is an object of the present invention to provide an Adjustable Reinforcing Hinge. The hinge of the present invention should act to replace an broken or otherwise damaged door hinge. The reinforcing hinge should be easily adjustable once installed in order to achieve superior alignment between the door and door jam. The hinge should be dimensioned so as to simplify the initial locating and mounting of the hinge on the door and door frame. The process for installing the reinforcing hinge should include the use of the specially-dimensioned elements of the hinge to also act as alignment guides during the location and installation of the reinforcing hinge.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings, of which:

FIGS. 8A through 8H are perspective views depicting the locating jig functionality of the embodiment of the invention of FIGS. 4–7.

DETAILED DESCRIPTION OF THE PREFERRED EMBODIMENTS

The following description is provided to enable any person skilled in the art to make and use the invention and sets forth the best modes contemplated by the inventor of carrying out his invention. Various modifications, however, will remain readily apparent to those skilled in the art, since the generic principles of the present invention have been defined herein specifically to provide an Adjustable Reinforcing Hinge.

Figure 1:
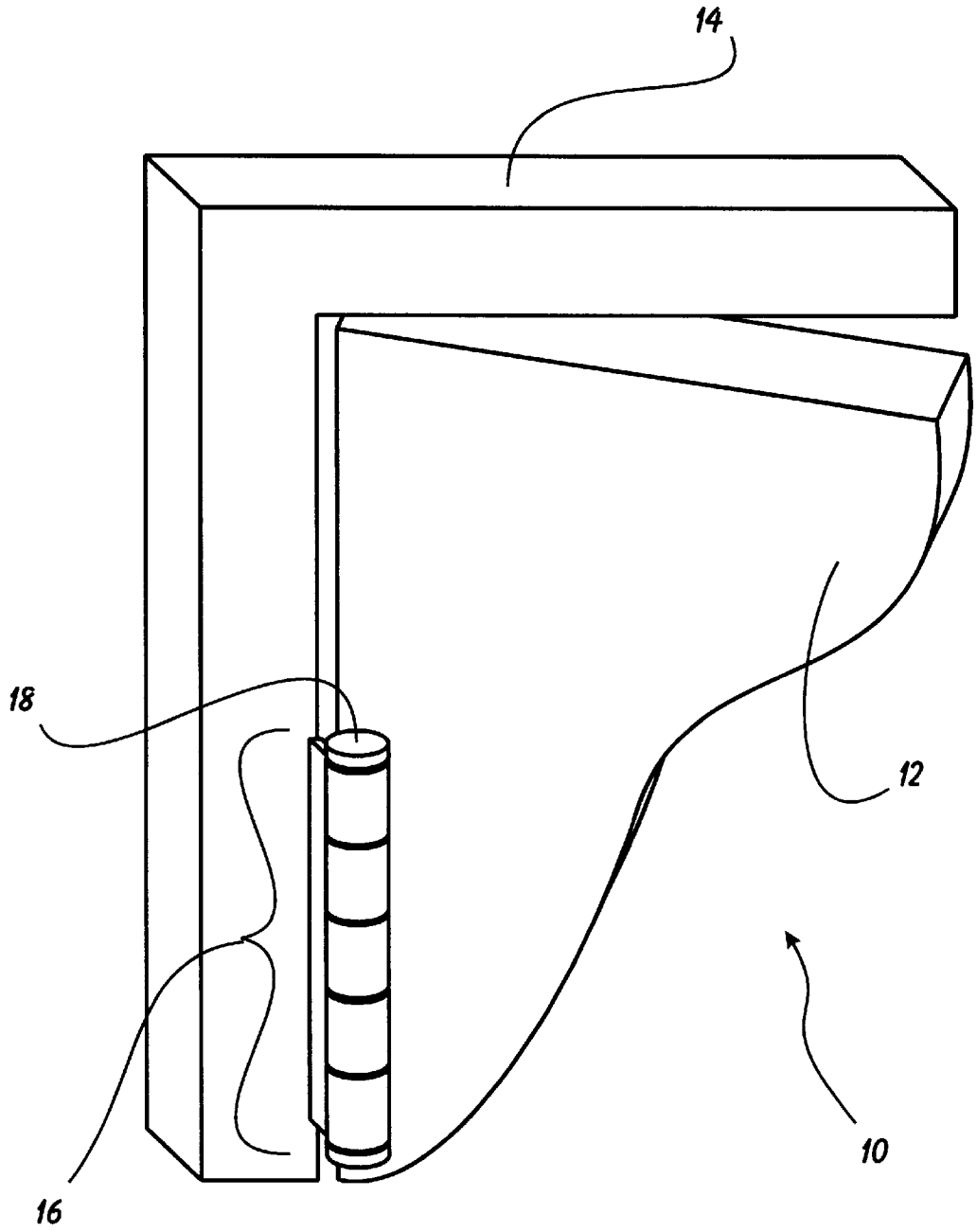
FIGURE 1 PRIOR ART
FIG. 1 is a perspective view of a conventional hinge door assembly.
Figure 2:
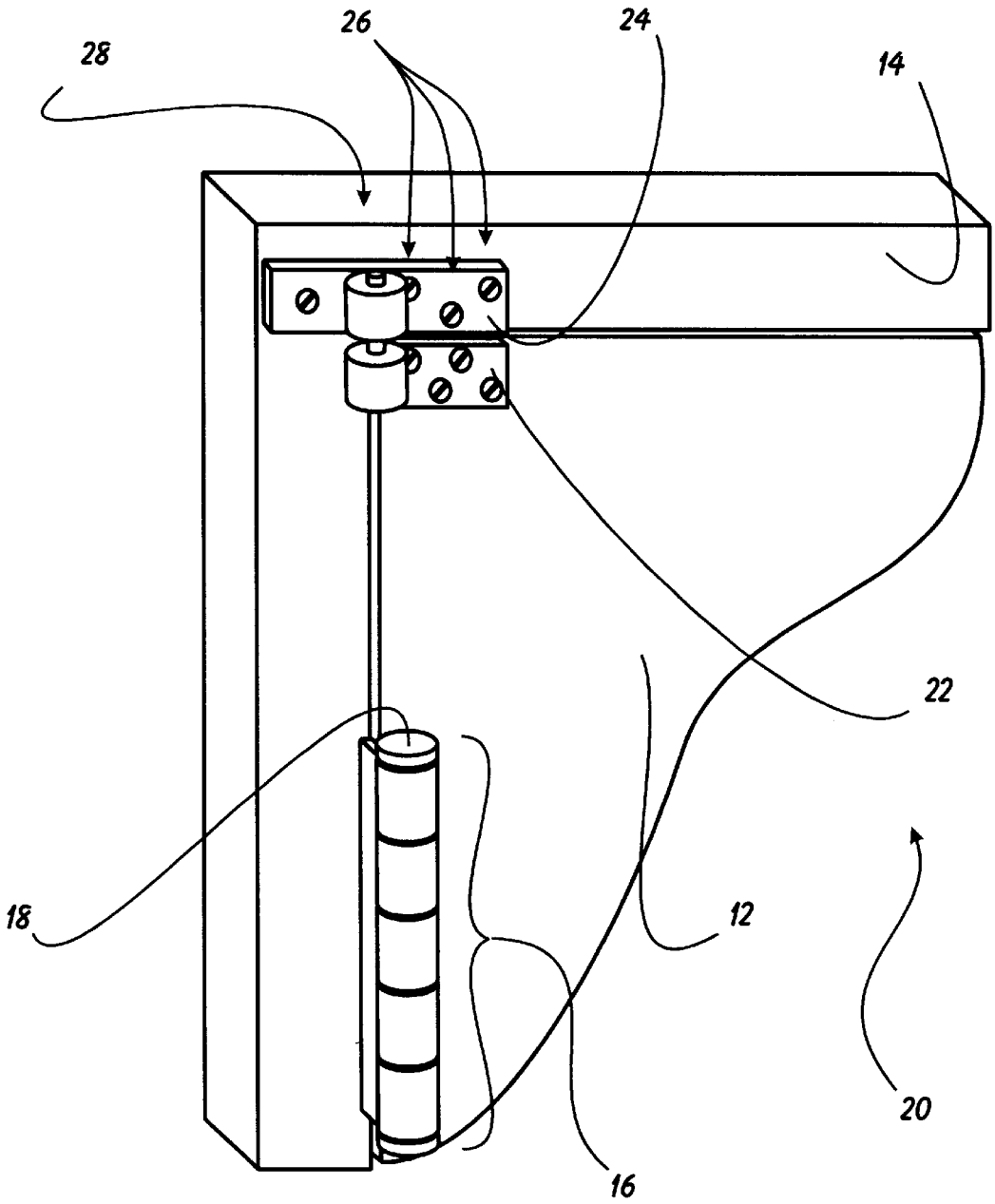
FIGURE 2 PRIOR ART
FIG. 2 is a perspective view of a prior art "shock pivot hinge;"
Figure 3:
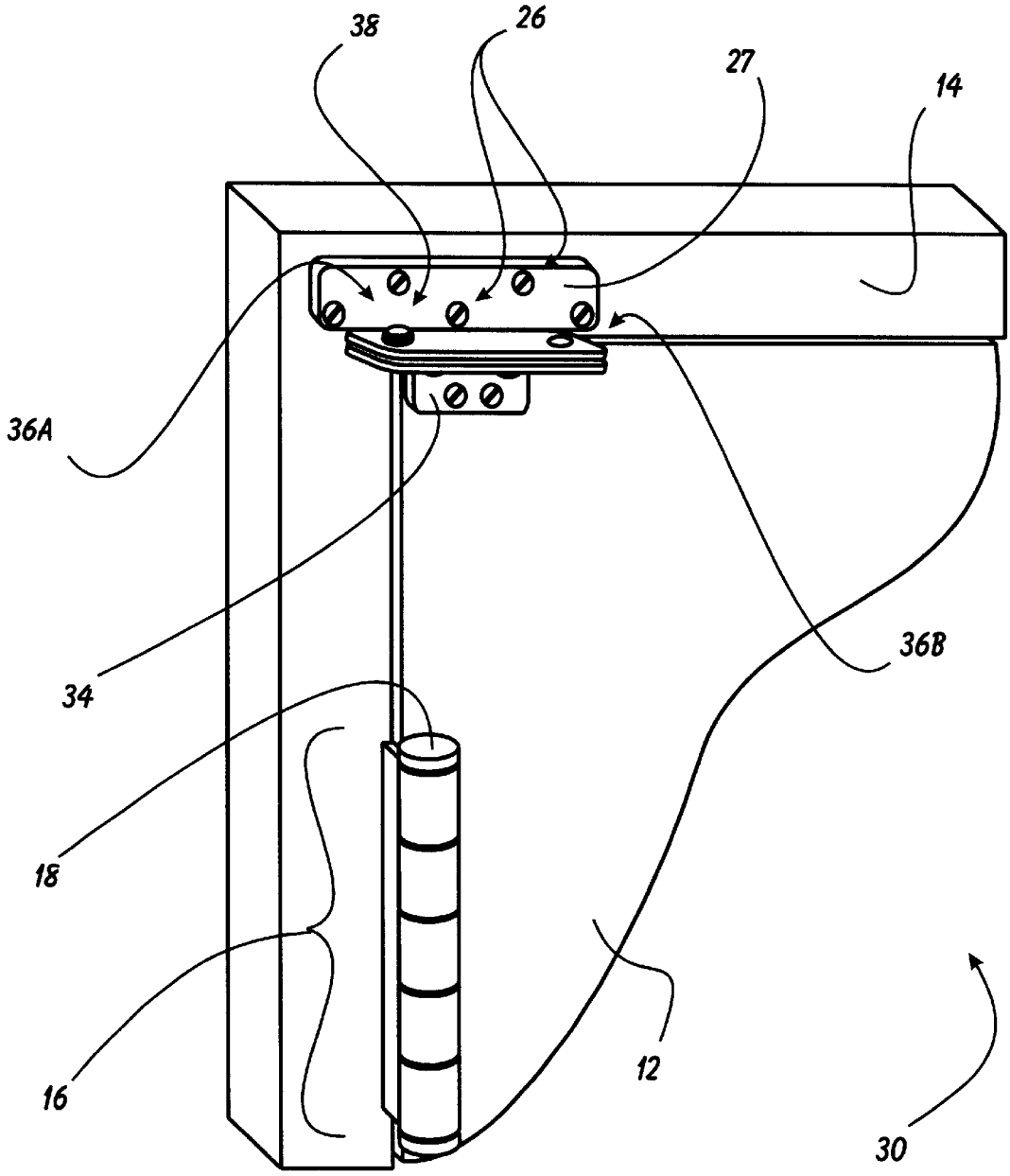
FIGURE 3 PRIOR ART
FIG. 3 is a perspective view of another prior art reinforcing hinge.
Figure 4:
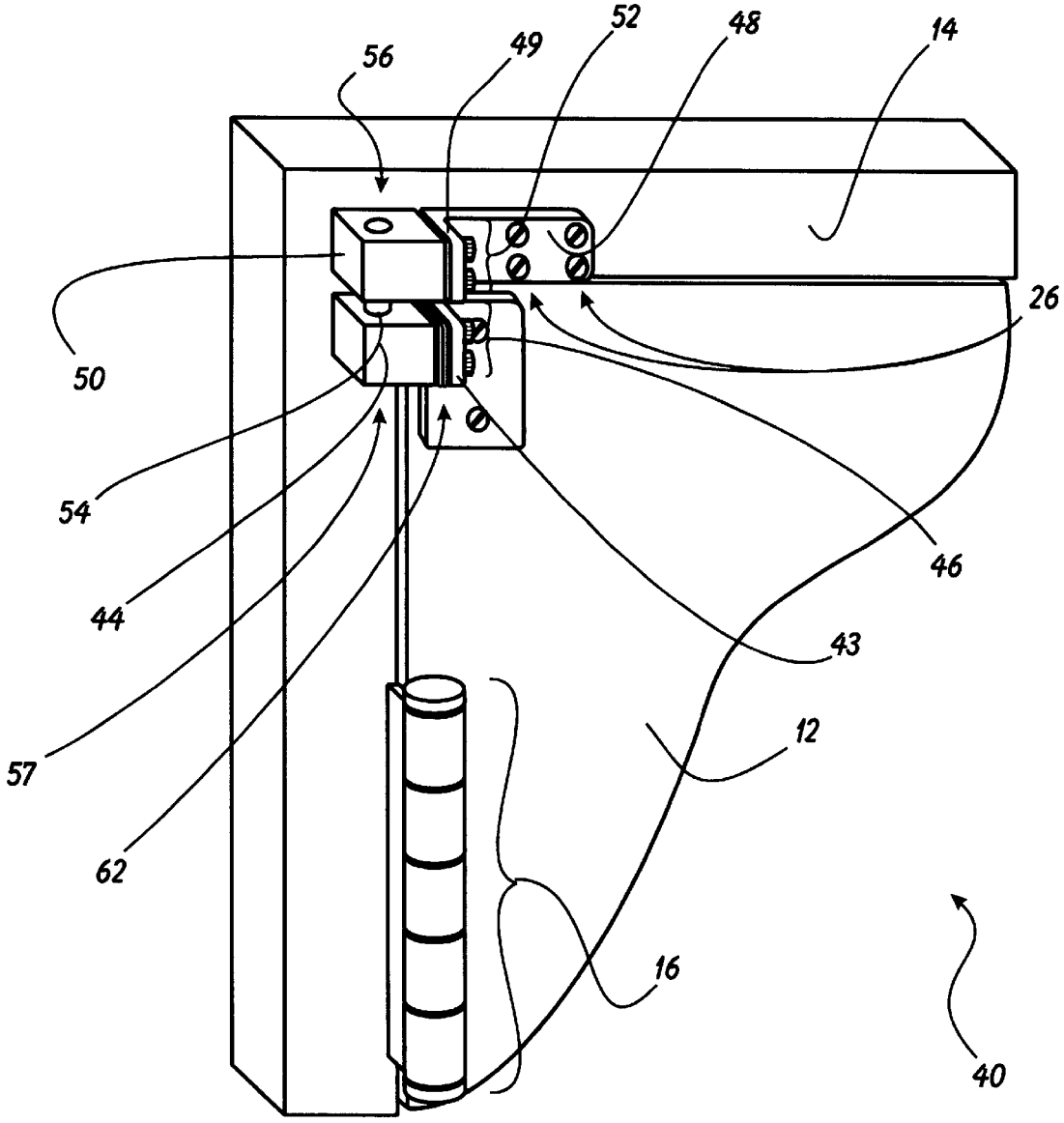
FIG. 4 is a perspective view of an embodiment of the adjustable reinforcing hinge of the present invention.

The present invention can best be understood by initial consideration of FIG. 4. FIG. 4 is a perspective view of an embodiment of the adjustable reinforcing hinge 40 of the present invention. As shown, the hinge 40 comprises a bottom plate 42 attached to the door 12 via two or more mounting screws 26. The bottom plate 42 is further defined by a fin 43 protruding outwardly from the bottom plate 42 substantially at a right angle. Although not depicted, the fin 43 is further defined by two or more slotted apertures, each for accepting a bottom adjustment bolt 46 therethrough. The bottom adjustment bolts 46, after passing through the slotted apertures (not shown), threadedly engage a pair of corresponding threaded bores formed in a bottom hinge block 44. More detail regarding these features is provided below in connection with FIG. 6. As should be appreciated, the slotted apertures (not shown) are slotted (i.e. rather than circular) in order to provide sliding adjustability between the bottom plate 42 and the bottom hinge block 44. The bottom hinge block 44 is not directly attached to the door 12 or frame 14; its only attachment is to the bottom plate 42 (and to the pivot pin 54, of course).

The hinge 40 further comprises a top plate 48 attached to the door frame 14 by two or more mounting screws. Extending generally at a right angle from the top plate 48 is a fin 49, which also has at least a pair of slotted apertures formed therein (not shown). Similar to the bottom plate 42/bottom hinge block 44 assembly, the top hinge block 50 attaches to the top plate by two or more top adjustment bolts 52 passing through the slotted apertures (not shown) and engaging a corresponding pair of threaded bores (not shown) formed in the top hinge block 50.

Another unique aspect of the hinge 40 of the present invention relates to the pivot pin 54. The pivot pin 54 is inserted into a pin bore 56 formed in the top hinge block 50, and further into a corresponding pin bore 60 (see FIG. 6) formed in the bottom hinge block 44. There is a critical difference between the top pin bore 56 and the bottom pin bore 60 (see FIG. 6), namely, that the top pin bore 56 is of a consistent diameter for its entire length, whereas the bottom pin bore 60 is closed on its bottom side (see FIG. 6). This design permits the pivot pin 54 to slideably engage both the top and bottom pin bores 56 and 60, and then rest on the closed bottom end of the bottom pin bore 60. This unique design permits the horizontal distance between the top hinge block 50 and the bottom hinge block 44 to be easily adapted (i.e. adjusted) for the particular door/frame arrangement; in fact, the pivot pin 54 might even be exchanged with a pin chosen from a group of pins of differing lengths. In order to permit lubrication and/or the expulsion of liquid contaminants, the bottom pin bore 60 (see FIG. 6) may further be provided with a drain aperture 57; this aperture 57 would have a diameter smaller than that of the bottom and top pin bores 56 and 60.

When installing the hinge 40, the user need simply attach the top and bottom plates 48 and 42 to the frame 14 and door 12, respectively, after which the top and bottom hinge blocks 50 and 44 are adjusted (via the top and bottom adjustment bolts 52 and 46) until the axis of the pivot pin 54 is aligned properly with the hinge pin of the door hinge 16. Further detail regarding the uniquely simple installation process is provided below in connection with FIGS. 8A and 8B, below.

Figure 5:
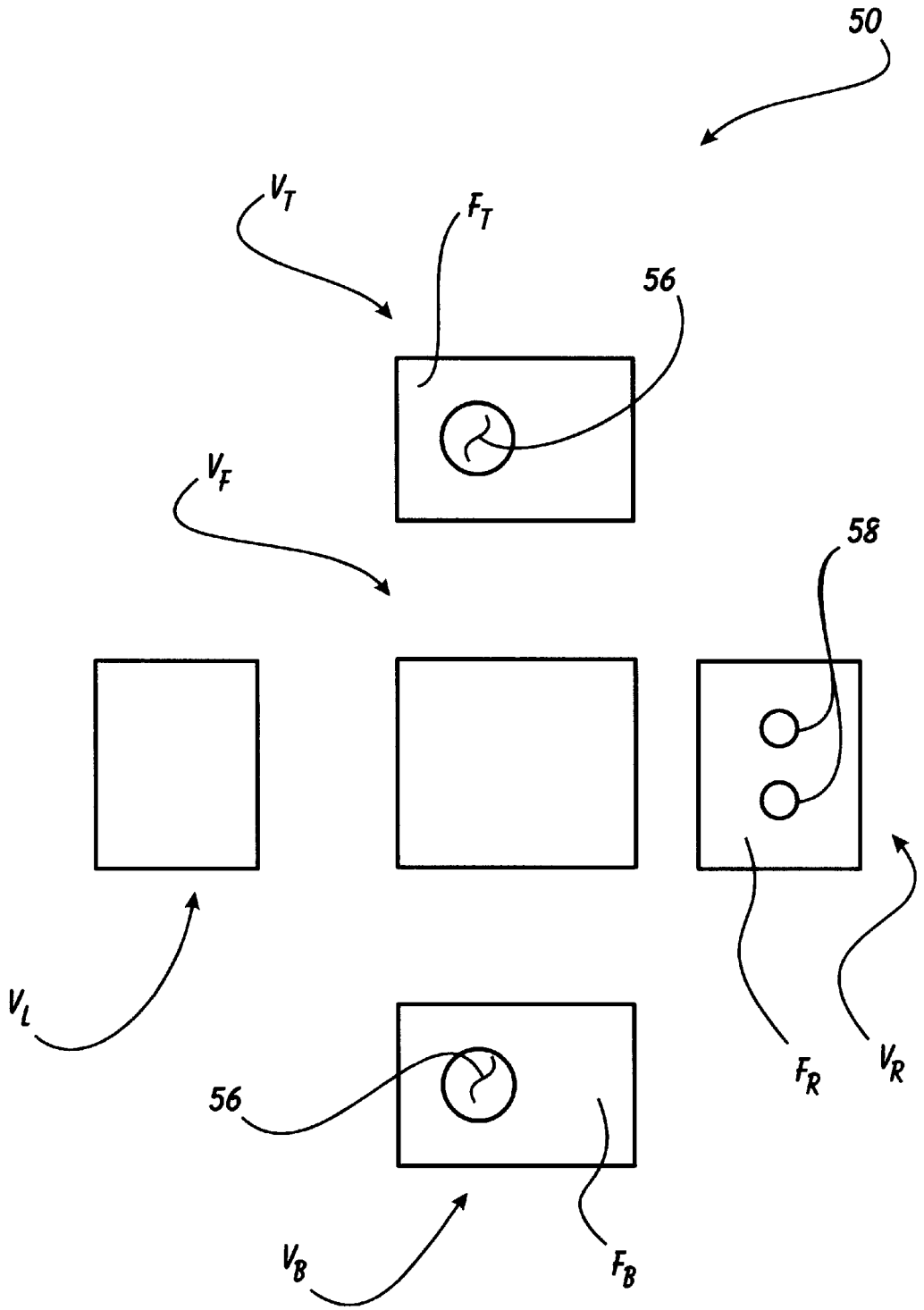
FIG. 5 is a plurality of views of the top hinge block of the embodiment of FIG. 4.

Now turning to FIG. 5, we can review the specific details regarding the top hinge block 50.

FIG. 5 is a plurality of views of the top hinge block 50 of the embodiment of FIG. 4. Depicted, we see a front view ($V_F$), a right side view ($V_{RS}$), a top view ($V_T$), a left side view ($V_{LS}$), and a bottom view ($V_B$). On the right face ($F_R$), we can see a pair of threaded bores 58 for accepting the top adjustment bolts (see FIG. 4). In other configurations, a different number of bores 58 may be provided, for example, to cooperate with more or fewer adjustment bolts (see FIG. 4). As is further shown, the diameter of the top pin bore 56 is the same on the top face ($F_T$), as it is on the bottom face ($F_B$); this ensures that the pivot pin (see FIG. 4) can slide through the top hinge block 50 smoothly. The top hinge block 50 is generally constructed from a solid piece of strong material, such as steel, however, other materials and construction designs might be feasible. Now turning to FIG. 6, we can review the specific details regarding the bottom hinge block 44.

Figure 6:
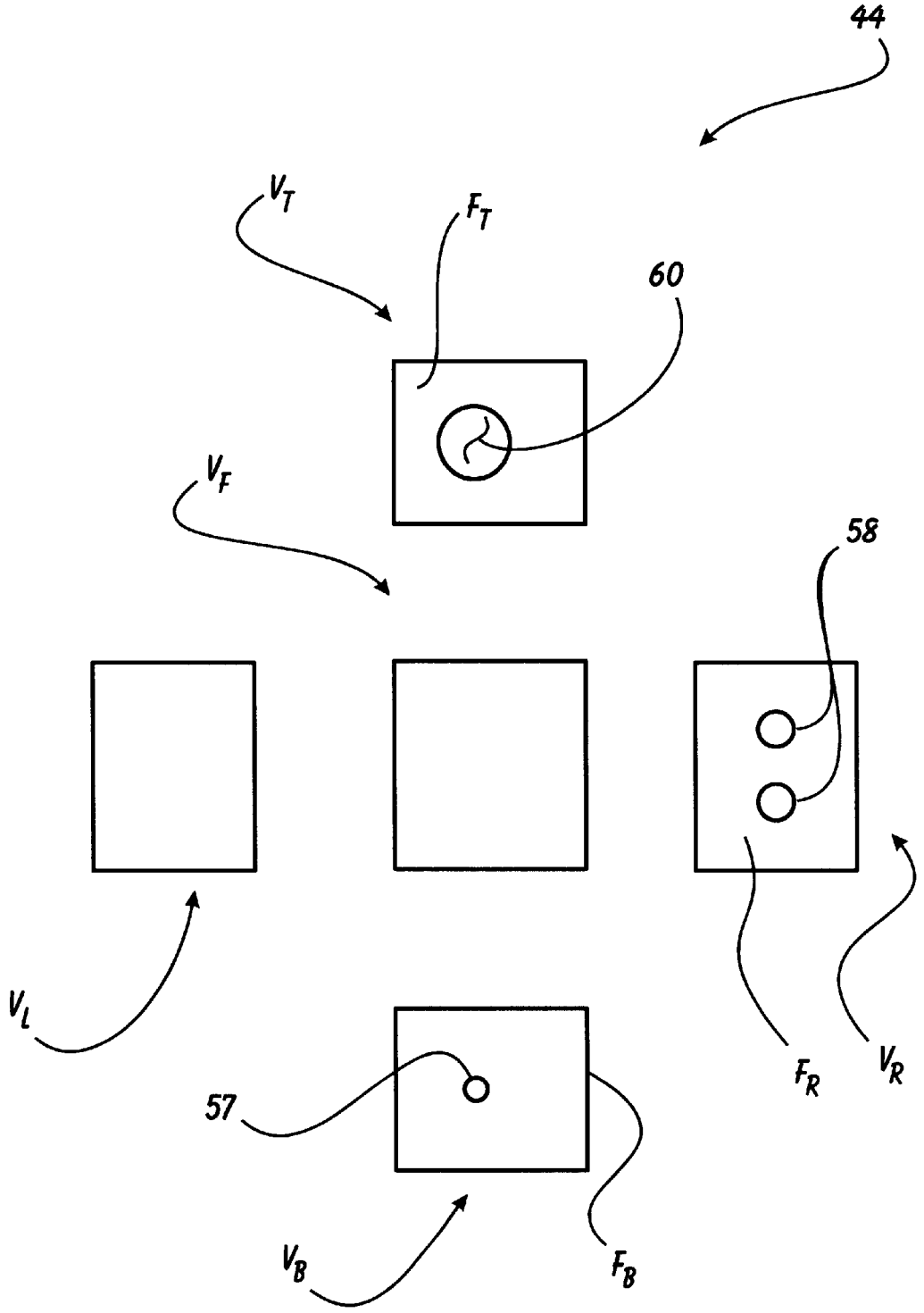
FIG. 6 is a plurality of views of the bottom hinge block of the embodiment of FIG. 4.

FIG. 6 is a plurality of views of the bottom hinge block 44 of the embodiment of FIG. 4. Similar to the top hinge block (see FIG. 5), the bottom hinge block 44 has about two threaded bores 58 on its right face ($F_R$), for accepting the bottom adjustment bolts (see FIG. 4) therein. In contrast to the top hinge block (see FIG. 5), however, the pin bore 60 does not have a consistent diameter through the entire block 44; as shown, the bore 60 on the top face ($F_T$) is a diameter adequate to accept the pivot pin (see FIG. 4), however, the bottom face ($F_B$) has a drain aperture 57 that is somewhat smaller than the diameter of the pivot pin (see FIG. 4). such that the pivot pin (see FIG. 4) will rest in the reservoir created by the substantially closed-ended bore 60. Now turning to FIGS. 7A and 7B, we can examine the hinge invention of the present invention in more detail.

Figure 7A:
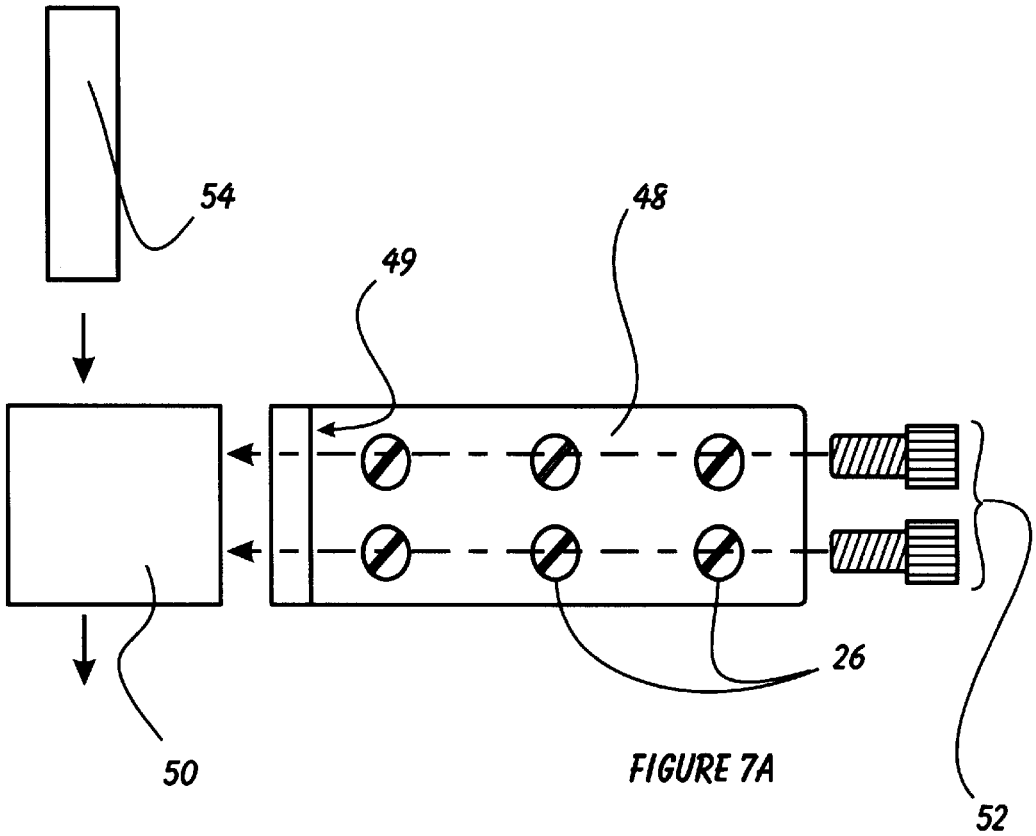
FIGS. 7A and 7B are an exploded front view of the top hinge block/top plate combination and side view of the top plate embodiments, respectively of the invention of FIGS. 4–6.

FIG. 7A is an exploded front view of the top hinge block 50/top plate 48 combination embodiment of the invention of FIGS. 4–6. As shown, the top adjustment bolts 52 pass through slotted apertures formed in the fin of the top plate 48 and into the top hinge block 50. What is also shown here is an optional shim member 62 sandwiched between the top plate 48 and the top hinge block 50; one or more of these shim members 62 might be added to the assembly in order to provide additional vertical dimensional adjustment to the assembly. Also depicted is the slidable pivot pin 54, as it might be inserted into the top bore (not shown) in the top hinge block 50.

Figure 7B:
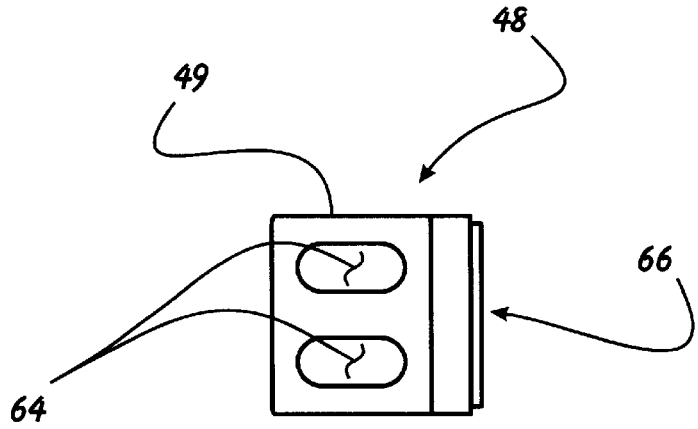

FIG. 7B depicts a right side view of the top plate of the embodiment of the present invention of FIGS. 4–6. As shown, the slotted apertures 64 are arranged for cooperation with the threaded bores (see FIG. 5). Further shown is that in some designs, an adhesive strip 66 is applied to the frame-side of the top plate 48. The adhesive strip 66 can be a conventional double-sided adhesive tape; it is provided to assist the installer in attaching the top plate 48 to the door frame (not shown). In use, it is a simple matter of removing the protective backing from the adhesive strip 66, and then sticking the top plate 48 to the door frame; after being stuck in place, it is a simple matter to drill and screw in the necessary mounting screws (see FIG. 4).

It should be understood that the top hinge block 50/top plate 48 combination is essentially identical in its component arrangement as the bottom hinge block/bottom plate combination (see FIG. 4). With regard to left- versus right-handed doors, it should be understood further that the threaded bores previously discussed in connection with FIGS. 5–7 would be located on opposite side face of the respective hinge block. Now turning to FIGS. 8A and 8B, we can examine yet another unique aspect of the present invention.

FIGS. 8A through 8H are perspective views depicting the locating jig functionality of the embodiment of the invention of FIGS. 4–7. Step 1, depicted by FIG. 8A, involves marking a frame edge layout line 70 on the top of the door frame 14, in alignment with the hinge side of the door 12. Next, as depicted in FIG. 8B, the bottom hinge block 44 is aligned to the frame layout line 70 (with the left or right face against the door frame 14), and a top plate layout line 72 (see FIG. 8C) is marked on the side of the block 44 that is opposite the frame edge layout line 70. Turning to FIG. 8D, next, the top plate 48 is temporarily attached to the door frame 14 in alignment with the top plate layout line 72 by operation of the adhesive strip located on the back side of the top plate (see FIG. 7B).

As in FIG. 8E, next the top hinge block 50 is attached to the top plate 72 by the top adjusting bolts 52. The pivot pin 54 is then inserted into the top pin bore 56. As shown in FIG. 8F, next the bottom hinge block 44 is slipped onto the pivot pin 54 (see FIG. 8E) and aligned to the edge of the door and frame. Next, as shown in FIG. 8G, the bottom plate 42 is loosely attached to the bottom hinge block 44 by bottom adjusting bolts 46 (and shim members, if necessary). The bottom plate 42 is then temporarily attached (using the adhesive strip on its back side) to the door and the adjusting bolts 46 are tightened. Finally, as depicted in FIG. 8H, the bottom plate 42 is permanently attached to the door 12 by mounting screws 26.

Those skilled in the art will appreciate that various adaptations and modifications of the just-described preferred embodiment can be configured without departing from the scope and spirit of the invention. Therefore, it is to be understood that, within the scope of the appended claims, the invention may be practiced other than as specifically described herein.

What is claimed is:

1. A reinforcing hinge assembly for a door attached to a door frame via hinges, the assembly comprising:

a top plate attached to the door frame by mounting screws, said top plate further defined by a fin, said fin defined by at least one fin aperture penetrating therethrough;

a top hinge block, said top hinge block defined by a top pin bore passing through a body of said top hinge block from a top face of said block to a bottom face of said block, said top hinge block further defined by at least one attachment bore on a side face of said top hinge block;

at least one adjustment bolt passing through said fin aperture and into one said top hinge block attachment bore, each said adjustment bolt attaching said top hinge block to said fin;

a bottom hinge block attached to the door frame;

a bottom plate attached to said bottom hinge block and the door; and a pivot pin interconnecting said top hinge block with said bottom hinge block in slidable cooperation.

2. The assembly of claim 1, wherein said bottom hinge block is further defined by a bottom pin bore cut into a top face of said bottom hinge block.

3. The assembly of claim 2, wherein said bottom hinge block is further defined by a drain aperture interconnecting said bottom pin bore with a bottom face of said bottom hinge block.

4. The assembly of claim 3, wherein said top plate fin is substantially at a right angle to said top plate; and said top plate fin further comprises a pair of attachment apertures in spaced relation.

5. The assembly of claim 4, wherein said attachment apertures are generally slot-shaped.

6. The assembly of claim 5, wherein said bottom plate is attached to the door by mounting screws, said bottom plate further defined by a bottom plate fin, said fin defined by at least one attachment aperture; and at least one adjustment bolt attaches said bottom hinge block to said bottom plate fin after passing through said attachment aperture.

7. The assembly of claim 6, further defined by at least one shim member captured between said top plate fin and said top hinge block.

8. The assembly of claim 7, further defined by a least one shim member captured between said bottom plate fin and said bottom hinge block.

* * * * *